United States Patent [19]

Prince et al.

[11] 4,114,510

[45] Sep. 19, 1978

[54] MUZZLE CLAMP ASSEMBLY

[75] Inventors: Ronald E. Prince, Winooski; Rene W. Bonnette, Burlington, both of Vt.

[73] Assignee: The United States of America as represented by the Secretary of the Air Force, Washington, D.C.

[21] Appl. No.: 791,753

[22] Filed: Apr. 28, 1977

[51] Int. Cl.[2] ..... F41D 7/04

[52] U.S. Cl. ..... 89/12; 89/1 L

[58] Field of Search ..... 89/12, 13 R, 13 A, 1 L, 89/126, 41 A

[56] References Cited

U.S. PATENT DOCUMENTS

| | | | |
|---|---|---|---|
| 1,334,983 | 3/1920 | Arter | 89/1 L |
| 1,448,587 | 3/1923 | Arntzen | 89/1 L |
| 2,872,847 | 2/1959 | Otto | 89/12 |
| 3,380,343 | 4/1968 | Chiabrandy et al. | 89/12 |
| 3,897,714 | 8/1975 | Perrin et al. | 89/12 |
| 4,015,508 | 4/1977 | Blodgett et al. | 89/12 |

*Primary Examiner*—David H. Brown

*Attorney, Agent, or Firm*—Joseph E. Rusz; Arsen Tashjian

[57] ABSTRACT

A muzzle clamp assembly, adapted for use with a multi-barrel gun of the Gatling type, for predictably controlling the dispersion, i.e., the impact point of projectiles fired from the multi-barrel gun. The assembly is removably attached to the forward end, i.e., the muzzle end, of the barrel cluster; and, it includes a perforated cylindrical clamp member, a plurality of movable and removable clamps, and a removable perforated front plate with the perforations at positions preselected to effectuate the desired controlled dispersion. These components are assembled and integrated in an untightened condition; are slipped over the muzzle end of the cluster of barrels; and, the movable clamps are tightened to the barrels, while the front plate is tightened to the clamp member. This front plate thereby positions the muzzles of the barrels to effectuate the preselected desired controlled dispersion of the fired projectiles, such as a dispersion pattern of 360° about a theoretical focal point.

7 Claims, 5 Drawing Figures

| LOCATION OF OPENINGS | | | | | | | | |
|---|---|---|---|---|---|---|---|---|
| SET | A | B | C | D | E | F | G | H |
| 1 | .947 | .939 | 1.877 | 1.887 | 1.623 | 1.623 | 1.615 | 1.615 |
| 2 | .977 | .942 | 1.877 | 1.917 | 1.617 | 1.617 | 1.586 | 1.586 |
| 3 | .997 | .944 | 1.877 | 1.937 | 1.613 | 1.613 | 1.566 | 1.566 |

MUZZLE CLAMP ASSEMBLY

STATEMENT OF GOVERNMENT INTEREST

The invention described herein may be manufactured and used by or for the Government for governmental purposes without the payment of any royalty thereon.

BACKGROUND OF THE INVENTION

This invention relates to a muzzle clamp assembly, adapted for use with a multi-barrel gun, such as a Gatling type gun.

A typical modern multi-barrel gun of the Gatling type is shown and is described in U.S. Pat. No. 2,849,921, issued to Harold McCall Otto on Sept. 2, 1958, and reference thereto and reading thereof is recommended. In essence, in a modern Gatling type multi-barrel gun, a plurality of parallel barrels are arranged for rotation as a cluster around a common axis, with each barrel firing in sequence, as it rotates and reaches the same (i.e., the common) predetermined position, such as "12 o'clock" (i.e., upper center).

Since such multi-barrel guns are boresighted to a common target, and further since it is frequently desirable to provide a controlled "shot-gun" effect (i.e., controlled dispersion), as distinguished from a "tight shot group" effect, such as when a gun of this type is to be used against a rapidly moving target (e.g., a hostile aircraft), a need arises for apparatus to be used in combination with the multi-barrel gun to attain the desired controlled dispersion of a burst of shots from such a gun. An apparatus of this type is shown and is described in U.S. Pat. No. 3,897,714, issued to Perrin et al. on Aug. 5, 1975, and reference thereto and reading thereof is recommended.

We have invented a muzzle clamp assembly which performs the same function as the Perrin et al. apparatus. However, my inventive assembly is far more simple; and, accordingly, is greatly more economical to manufacture.

Therefore, we have significantly advanced the state-of-the-art. We have done so by keeping in mind the well-known facts that, although the barrels of the multi-barrel gun are parallel to each other and have a common axis and are boresighted to a common target, the muzzle of each of the barrels in deflectable, within limits.

SUMMARY OF THE INVENTION

Accordingly, the principal object of this invention is to provide a unique muzzle clamp assembly for use with a multi-barrel gun of the Gatling type to obtain a controlled dispersion effect.

This principal object, as well as other related objects (e.g., simplicity in structure, simplicity in use, and economy of manufacture), of this invention will become readily apparent after a consideration of the description of the invention, together with reference to the Figures of the drawings.

DESCRIPTION OF THE PREFERRED EMBODIMENT

Figure 1:
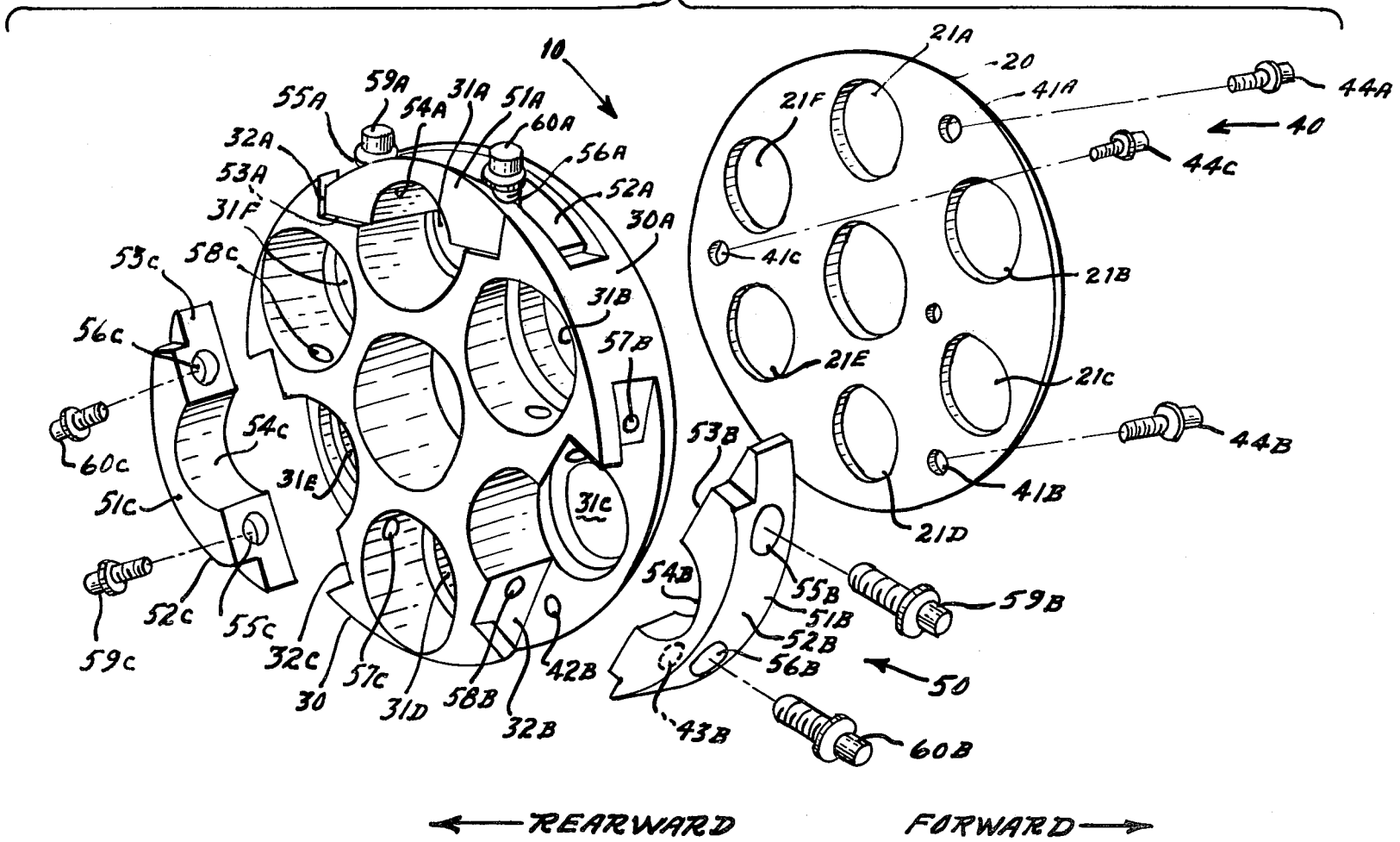
FIG. 1 is an exploded view, in perspective and in simplified form, of a preferred embodiment of the invention, as adapted for use with a six-barrel gun of the Gatling type.

With reference to FIGS. 1–4, inclusive, wherein the same members, elements, components and the like have been assigned the same reference numerals, therein is shown, in various simplified views, a preferred embodiment 10, or portion thereof, of our muzzle clamp assembly.

Figure 3:
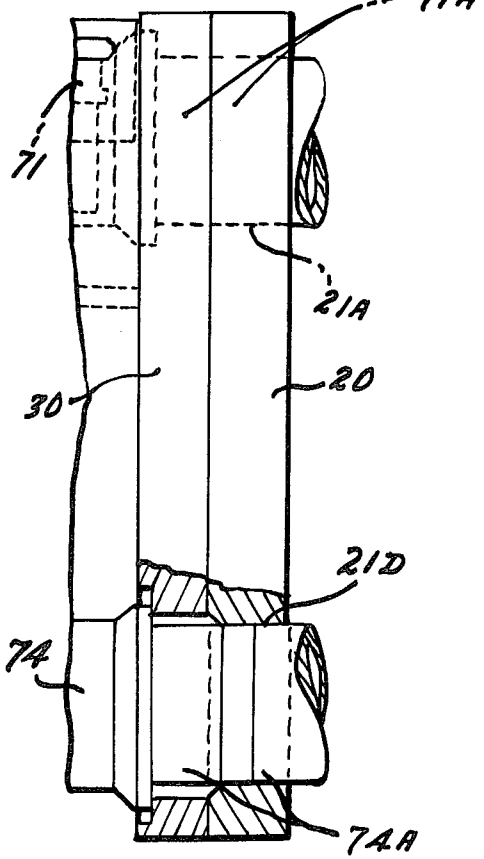
FIG. 3 is a side elevation view, partially fragmented, partially in cross section, and in simplified form, showing the preferred embodiment of our muzzle clamp assembly in position at the muzzle end of two representative barrels, rather than all six barrels, in the interest of maintaining simplicity of the drawing.

In its most basic and generic form, the preferred embodiment 10, comprises: a perforated front plate 20; a perforated cylinder-like clamp member 30 disposed rearward of the front plate 20; means, generally designated 40, for releasably connecting the front plate 20 to the clamp member 30; and, means generally designated 50, for removably attaching the front plate 20, the clamp member 30, and the means 40 for releasably connecting the front plate 20 to the clamp member 30, to the muzzle end of the multi-barrel (i.e., six barrel) Gatling type gun, as shown by representative barrels 71 and 74, FIG. 3, having, respectively, muzzle 71A and 74A.

Figures 4, 5:
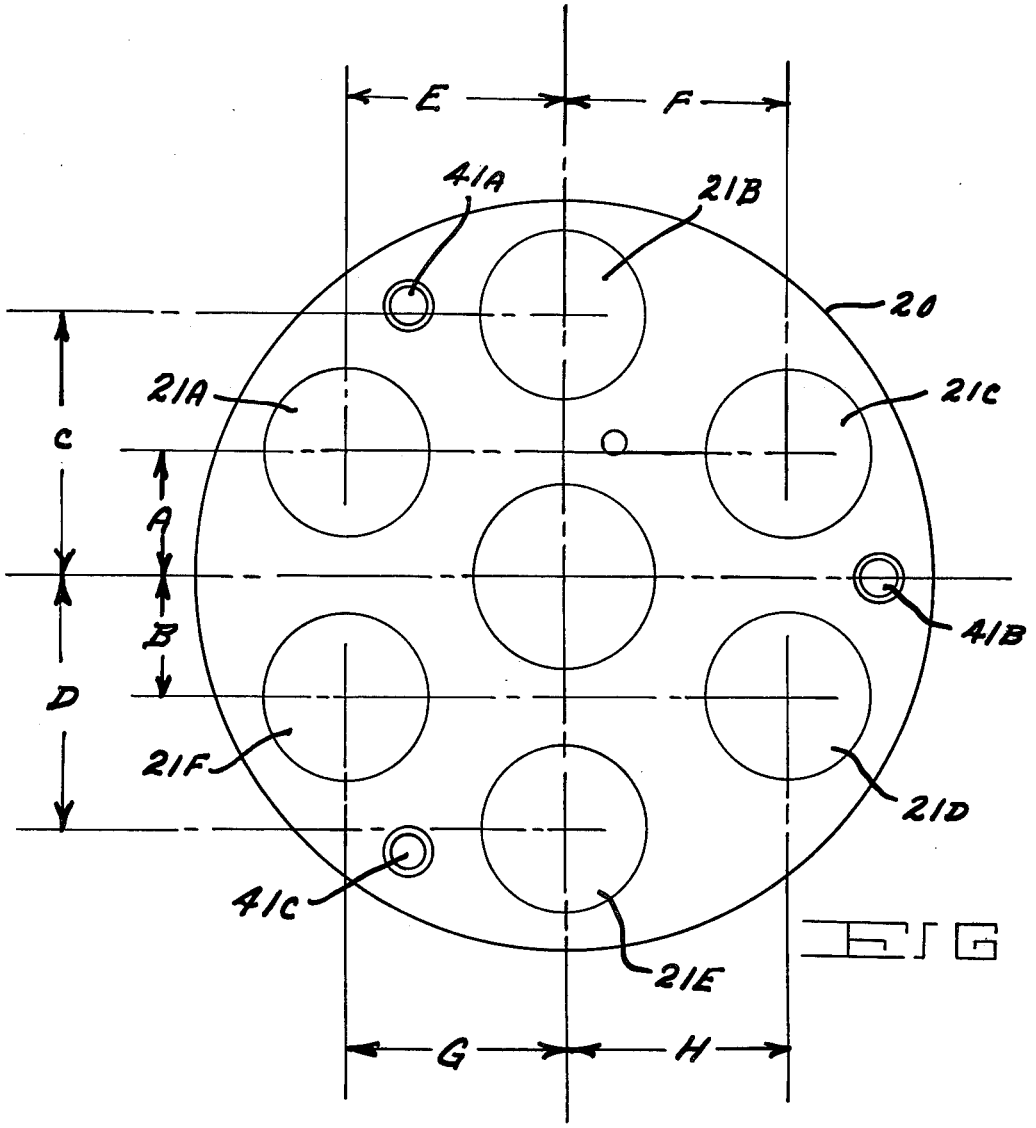
FIG. 4 is a front view, in simplified form, of the front plate component of our inventive muzzle clamp assembly.
FIG. 5 is a chart showing preferred, and useable, locations of the barrel openings in three different cases of desired controlled dispersion, for the same six-barrel Gatling type gun.

More specifically, the front plate 20 has a first plurality of openings therein and therethrough, preferably six identical ones (i.e., one opening for each of the six identical barrels of a Gatling type multi-barrel gun), such as 21A–21F, inclusive, with each of these openings dimensioned and configurated to accept, snugly fit on, and surround the muzzle end of its respective barrel of the six barrel cluster, e.g., opening 21A and muzzle 71A of representative barrel 71; and opening 21D and muzzle 74A of representative barrel 74, FIG. 3, with the openings 21A–21F, inclusive, of this first plurality located at preselected positions on and in the front plate, as shown in FIG. 4, and as will be explained later herein. However, since each barrel of the multi-barrel gun has a transverse circular cross section, FIG. 2, each of the openings 21A–21F, of this first plurality, in the front plate is circular and, in order to provide the desired snug fit at the muzzle end, is only slighly larger (i.e., the circumference is only slightly greater) than the muzzle end of the respective barrel. In addition, as a matter of preference rather than of limitation, the front plate 20 has a circular perimeter, and is generally in the form of a disc (i.e., flat and thin).

The clamp member 30 is disposed rearward of the front plate 20 and has a first plurality of openings therein and therethrough, preferably six as hereinbefore explained, such as 31A–31F, inclusive. However, unlike the openings in the front plate, these clamp member openings are not identical. One of the openings 31A is circular and in all other respects is identical to all of the openings 21A–21F in the front plate; whereas, the other five openings in the clamp member, 31B–31F, are identical to each other and are larger than opening 31A.

Also, the clamp member 30 is preferably in the form of a right circular cylinder having a cylindrical surface 30A in which there are a plurality of recesses, such as 32A–32C, inclusive. Preferably, these recesses are identical, and each is generally in a geometric form or configuration that is complementary to what will be referred herein to as "a segment of a cylinder." In that regard, such a segment is a three dimensional version (or equivalent) of a two dimensional segment of a circle, i.e., that portion of a circle defined by an arc of the circle and its chord.

The means, already generally designated 40, for releasably connecting the front plate 20 to the clamp member 30, includes: a second plurality of openings, such as 41A, 41B, and 41C, in and through front plate 20; a second plurality of openings, such as 42A, 42B, and 42C, in and through clamp member 30, with one such opening for each of the second plurality of front plate openings, and in registration therewith, e.g., opening 41B in front plate 20 is in registration with opening 42B in clamp member 30; a plurality of internally threaded cavities, such as 43A, 43B and 43C, with one such cavity in each of a plurality of clamps (which will be described later herein), e.g., cavity 43B in clamp 51B, and with one such cavity for each of the second plurality of clamp member openings, e.g., cavity 43B for clamp member opening 42B, and in registration therewith, e.g., cavity 43B is in registration with clamp member opening 42B; and, a plurality of bolts, such as 44A, 44B, and 44C for each clamp cavity, e.g., bolt 44B is for clamp cavity 43B, with each such bolt externally threaded to complement the internal threading of the clamp cavities, and with each bolt removably inserted and passing through its respective second plurality front plate opening, such as 41B, and its respective second plurality clamp member opening, such as 42B, and fitting into its respective clamp cavity, such as 43B, and mating with the complementary threading therein. Preferably, rather than by way of limitation: the second plurality of front plate openings are three in number, i.e., 41A, 41B and 41C, and each of these openings is identical; the second plurality of clamp member openings are also three in number, i.e., 42A, 42B and 42C, and each of these openings is identical to each other and, as well, is identical to each of the front plate openings 41A, 41B, and 41C; the plurality of internally threaded clamp cavities are also three in number, i.e., 43A, 43B, and 43C, and each of these threaded cavities is identical; and, the plurality of complementarily threaded bolts for passage through the front plate 20 and the clamp member 30, and for engagement with the clamp cavities, are also three in number, i.e., 44A, 44B, and 44C, and each of these bolts is identical.

The means, already generally designated 50, for removably attaching the front plate 20, the clamp member 30, and the releasable front plate-to-clamp member connecting means 40, to the multi-barrel gun at the muzzle end of the barrels of the gun, includes a plurality of identical clamps, such as 51A, 51B, and 51C, one clamp for each clamp member recess 32A, 32B, 32C, e.g., clamp 51B for clamp member recess 32B, with each clamp generally in the form of a segment of a cylinder that is configurated complementary to, and is dimensioned to fit into, its respective clamp member recess, and with each clamp having an arcuate outer surface (i.e., 52A, 52B, and 52C of, respectively, clamps 51A, 51B, and 51C), and an inner surface (i.e., 53A, 53B and 53C of, respectively, clamps 51A, 51B, and 51C), with the inner surface having an arcuate central portion (i.e., 54A, 54B, and 55C) that is shaped to abut with a muzzle end of a barrel of the identical multi-barrels of the gun, and also with each clamp having a plurality of passageways, such as 55A, 55B, 55C, 56A, 56B, and 56C, in and through the respective clamp, extending from the outer surface to the inner surface of the clamp. As a matter of preference, rather than of limitation, the plurality of identical clamps are three in number, and the plurality of clamp passageways are six in number (i.e., two per clamp) and are identical.

The means 50 also includes: a plurality of internally threaded identical cavities, such as 57A, 57B, 57C, 58A, 58B, and 58C, in the clamp member, with one cavity for each passageway in each clamp, such as cavity 57B for passageway 55B in and through clamp 51B; and, a plurality of identical bolts, such as 59A, 59B, 59C, 60A, 60B, and 60C, one bolt for each internally threaded clamp member cavity, such as 57B, with each bolt externally threaded to complement and to mate with the internal threading of its respective clamp member cavity, such as bolt 59B and its respective cavity 57B, and with each bolt passing through a different one of the passageways in the clamps and into its respective threaded cavity, such as bolt 59B passing through passageways 55B and into threaded cavity 57B, wherein each bolt is threadedly engaged with complementary threading in its respective cavity and, thereby, to the respective cavity itself. Preferably, the plurality of threaded cavities in the clamp member are six in number (i.e., two per recess), and the plurality of threaded bolts are identical and are six in number (i.e., two per clamp).

Now, specifically with reference to FIG. 4, therein is shown the front plate component 20, of our inventive muzzle clamp assembly 10, with the first plurality of openings 21A–21F, inclusive, therein. These openings are located at positions preselected to effectuate the desired controlled dispersion of projectiles fired from and out of the muzzle of the barrels of the multi-barrel gun.

Assuming that the desired controlled dispersion is a dispersion pattern of 360° about a theoretical focal point of the first firing barrel (i.e., the barrel whose muzzle is positioned, in this example, in opening 21B of front plate 20). If such is the situation, as it is assumed to be in this case, then the chart in FIG. 5 shows three separated and distinct sets of dimensions, variously designated "A" – "H," inclusive, which will preselect the positions of the centers of the circular openings of flat plate 20 to achieve the above-mentioned desired result.

MANNER OF USE AND OPERATION OF THE PREFERRED EMBODIMENT

The manner of use and operation of the preferred embodiment 10 of our inventive muzzle clamp assembly can be ascertained very easily by a person of ordinary skill in the art from the foregoing description, together with reference to the Figures of the drawings.

For others, it is sufficient to say in explanation, the following:

The constituent components of the muzzle clamp assembly 10 are assembled, and integrated, in a connected, but untightened condition. Then, the assembly 10, as a whole, is slipped over the muzzle end of the barrels of the multi-barrel gun, FIG. 3, with each muzzle end passing through a different clamp plate opening and its respective corresponding front plate opening, FIG. 2, and with each of three of the barrels, such as 71, 73, and 75, FIG. 2, also passing between a clamp and a clamp member recess, such as barrel 75 between clamp 51C and clamp member recess 32C, FIGS. 1 and 2.

Figure 2:
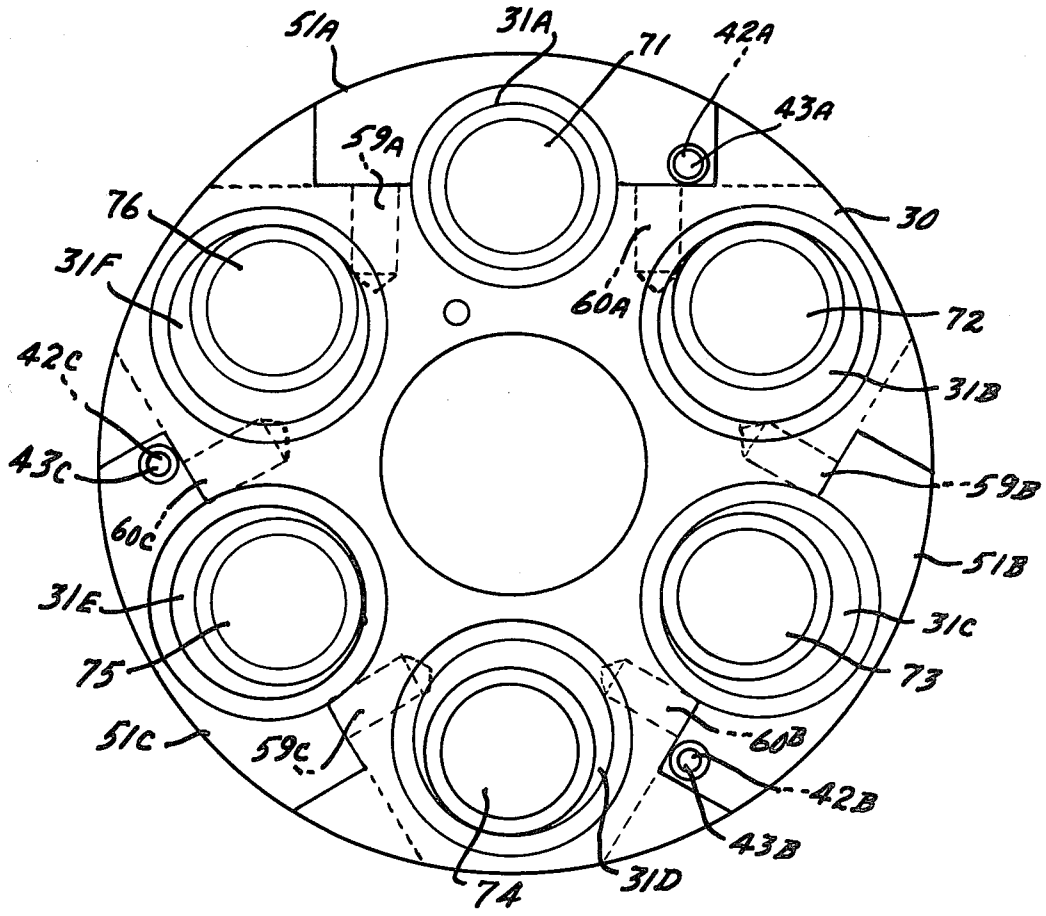
FIG. 2 is a rear view, partially in cross section and in simplified form, of the inventive muzzle assembly, assembled and in use while removably attached to the six barrels of the gun at their respective muzzle ends.

Then, the clamps, such as 51A, 51B, 51C, FIG. 1, are tightened by tightening the clamp (passageway) bolts, such as 59A, 59B, 59C, 60A, 60B and 60C, FIGS. 1 and 2; and, the front plate 20, FIG. 1, is tightened by tightening bolts 44A, 44B and 44C, FIG. 1. This results in the front plate deflecting the muzzle end of five of the barrels, such as 72, 73, 74, 75 and 76, FIG. 2. This also results in the front plate 20 and the clamp member 30, in combination, holding (by abutting contact) all six barrels 71–76, inclusive, FIG. 2. In this regard, it is to be noted that, although the front plate circular openings 21B–21F, inclusive, and the clamp member circular openings 31B–31F, inclusive, for the muzzles of barrels 72–76, FIG. 2, are aligned, they are not of the same size and are not concentric, but rather are in an eccentric (i.e., off center) geometric relationship. As a consequence of this, the muzzles of all of the barrels are held in preselected positions from which; and, as a projectile is fired sequentially from each barrel, as each barrel rotates to the common predetermined position (such as the initial "12 o'clock" position of barrel 71, FIGS. 2 and 3), then each group of six fired projectiles will form the predicted, and desired, dispersion pattern of 360°, e.g., a full dispersion of 360° with central coverage by the projectile(s) fired from barrel 71.

CONCLUSION

It is abundantly clear from all of the foregoing, and from the contents of the Figures of the drawings, that the stated principal objects, as well as other related objects, of our inventive muzzle clamp assembly have been attained.

It is to be noted that, although there have been described the fundamental and unique features of our invention as applied to a particular preferred embodiment, and as adapted for use with a multi-barrel gun having six barrels, various other embodiments, adaptations, substitutions, additions, omissions, and the like, may occur to, and can be made by, those of ordinary skill in the art, without departing from the spirit of our invention. For example, our invention may be adapted for use with any Gatling type gun having any number of a plurality of barrels.

What is claimed is:

1. A muzzle clamp assembly, adapted for use with a multi-barrel gun, wherein each barrel has a muzzle end, comprising:

a. a front plate having a first plurality of openings therein and therethrough, one opening for each barrel of said multi-barrel gun, with each opening so dimensioned and configurated to accept, snugly fit on, and surround said muzzle end of its respective barrel, wherein said openings are located at preselected positions on and in said front plate;

b. a clamp member, disposed rearward of said front plate, having a first plurality of openings therein and therethrough, one opening for each of said first plurality of front plate openings, with each said clamp member opening of said first plurality and in eccentric geometric relationship with and to its respective front plate opening;

c. means for releasably connecting said front plate to said clamp member;

d. and, means for removably attaching said front plate, said clamp member, and said releasable front plate-to-clamp member connecting means, to said multi-barrel gun at the muzzle end of said barrels of said gun.

2. A muzzle clamp assembly, as set forth in claim 1, wherein each barrel of said multi-barrel gun is identical and has a transverse circular cross section, and wherein each said front plate opening of said first plurality is identical, is circular, and is slightly larger than said transverse circular cross section of each said barrel, whereby each said front plate opening of said first plurality of front plate openings snugly fits around its respective barrel, and also each said clamp member opening of said first plurality of clamp member openings is circular, with one of said plurality of clamp member openings identical to each front plate opening of said first plurality of front plate openings, and further wherein the other of said first plurality of clamp member openings are identical to each other, are circular, and are larger than said other clamp member opening.

3. A muzzle clamp assembly, as set forth in claim 2, wherein said front plate has a circular perimeter and is generally in the form of a disc, and wherein said clamp member is essentially in the form of a right circular cylinder having a cylindrical surface with a plurality of recesses therein.

4. A muzzle clamp assembly, as set forth in claim 3, wherein said plurality of clamp member recesses are identical and each is generally in a form complementary to a segment of a cylinder.

5. A muzzle clamp assembly, as set forth in claim 4, wherein said means for removably attaching said front plate, said clamp member, and said releasable front plate-to-clamp member connecting means, to said multi-barrel gun at the muzzle end of said barrels to said gun, includes:

a. a plurality of identical clamps, one clamp for each of said plurality of clamp member recesses, with each clamp generally in the form of a segment of a cylinder configurated complementary to, and dimensioned to fit into, its respective clamp member recess, and with each said clamp having an arcuate outer surface, and an inner surface with an arcuate central portion shaped to abut with a muzzle end of a barrel of said identical multi-barrels of said gun, and also with each said clamp having a plurality of passageways in and through said clamp from said outer surface to said inner surface;

b. a plurality of internally threaded identical cavities in said clamp member, with one cavity for each passageway in each said clamp;

c. and, a plurality of identical bolts, one bolt for each internally threaded cavity in said clamp member, with each bolt externally threaded to complement and mate with the internal threading of its respective clamp member cavity, and with each bolt passing through a different one of said passageways in said clamps and into its respective cavity, wherein it is threadedly engaged with and to said cavity.

6. A muzzle clamp assembly, as set forth in claim 5, wherein said means for releasably connecting said front plate to said clamp member includes:

a. a second plurality of openings in and through said front plate;

b. a second plurality of openings in and through said clamp member, with one such opening for each of said second plurality of front plate openings and in registration therewith;

c. a plurality of internally threaded cavities, with one such cavity in each of said clamps, and with one such cavity for each of said second plurality of clamp member openings and in registration therewith;

d. and, a plurality of bolts externally threaded to complement the internal threading of said cavities, with one such bolt for each said clamp cavity, and with each bolt removably inserted and passing through its respective second plurality front plate opening and its respective second plurality clamp member opening, and fitting into its respective clamp cavity and mating with said threading therein.

7. A muzzle clamp assembly, as set forth in claim 6, wherein:

a. said first plurality of indentical front plate openings are six in number;

b. said first plurality of identical clamp member openings are six in number;

c. said plurality of identical recesses in said clamp member are three in number;

d. said plurality of identical clamps are three in number;

e. said plurality of clamp passageways are two in number and are identical;

f. said plurality of threaded bolts for passage through clamp passageways are six in number and are identical;

g. said plurality of cavities in said clamp member are six in number and are identical;

h. said second plurality of front plate openings are three in number and are identical;

i. said second plurality of clamp member openings are three in number and are identical;

j. said plurality of internally threaded clamp cavities are three in number and are identical;

k. and, said plurality of complementarily threaded bolts for passage through said front plate and said clamp member, and for engagement with said threaded clamp cavities, are three in number and are identical.

* * * * *